US009019084B2

(12) United States Patent
Maier

(10) Patent No.: US 9,019,084 B2
(45) Date of Patent: Apr. 28, 2015

(54) WIRELESS REMOTE CONTROL

(75) Inventor: Ferdinand Maier, Obertrum am See (AT)

(73) Assignee: FM Marketing GmbH, Obertrum am See (AT)

( * ) Notice: Subject to any disclaimer, the term of this patent is extended or adjusted under 35 U.S.C. 154(b) by 594 days.

(21) Appl. No.: 13/388,589

(22) PCT Filed: Aug. 5, 2010

(86) PCT No.: PCT/EP2010/004812
§ 371 (c)(1),
(2), (4) Date: Feb. 2, 2012

(87) PCT Pub. No.: WO2011/015363
PCT Pub. Date: Feb. 10, 2011

(65) Prior Publication Data

US 2012/0126957 A1 May 24, 2012

(30) Foreign Application Priority Data

Aug. 7, 2009 (DE) ..... 10 2009 036 586

(51) Int. Cl.
*G05B 11/01* (2006.01)
*G08C 17/00* (2006.01)

(52) U.S. Cl.
CPC ..... *G08C 17/00* (2013.01); *G08C 2201/10* (2013.01)

(58) Field of Classification Search
CPC .. A61G 2203/12; G06F 3/0414; G08C 19/12; A63F 2300/1031; G08B 13/1409; G05B 11/01
USPC ..... 340/12.5; 604/20; 307/115; 710/62; 709/209
See application file for complete search history.

(56) References Cited

U.S. PATENT DOCUMENTS

| | | | | |
|---|---|---|---|---|
| 4,575,680 | A * | 3/1986 | Gold | 324/433 |
| 5,857,994 | A * | 1/1999 | Flower | 604/20 |
| 6,377,848 | B1 * | 4/2002 | Garde et al. | 604/20 |
| 6,750,801 | B2 | 6/2004 | Stefanik | |
| 7,348,537 | B2 * | 3/2008 | Akagi et al. | 250/221 |
| 7,385,548 | B2 | 6/2008 | Stefanik | |
| 2002/0084929 | A1 | 7/2002 | Stefanik | |
| 2005/0141208 | A1 * | 6/2005 | Niinuma | 361/797 |

(Continued)

FOREIGN PATENT DOCUMENTS

| | | | |
|---|---|---|---|
| KR | 10-2003-0012873 | * | 9/2004 |
| KR | 1020040077349 | A | 9/2004 |
| WO | 2009015869 | A1 | 2/2009 |

OTHER PUBLICATIONS

Abstract of WO2009015869; Feb. 5, 2009.

(Continued)

*Primary Examiner* — Quang D Pham
(74) *Attorney, Agent, or Firm* — Senniger Powers LLP

(57) ABSTRACT

A wireless remote control comprising a sensor that generates an output signal as a function of its alignment that directly or indirectly activates or deactivates at least one electronic circuit, a plug socket, a first contact of the plug socket connected to a control input of a power supply device, an external plug that connects the first contact to a second contact when inserted into the plug socket and thus the power supply device is deactivated independently of the output signal of the sensor.

2 Claims, 2 Drawing Sheets

(56) References Cited

U.S. PATENT DOCUMENTS

| | | | | |
|---|---|---|---|---|
| 2005/0206549 | A1 | 9/2005 | Stefanik | |
| 2006/0136623 | A1* | 6/2006 | Elazar et al. | 710/62 |
| 2006/0294272 | A1* | 12/2006 | Chou et al. | 710/62 |
| 2009/0283600 | A1* | 11/2009 | Chang et al. | 235/441 |
| 2010/0127914 | A1 | 5/2010 | Maier | |
| 2010/0164299 | A1* | 7/2010 | Lee et al. | 307/115 |

OTHER PUBLICATIONS

International Search Report, PCT/EP2010/004812, Jan. 14, 2011, 3 pages.
Written Opinion, PCT/EP2010/004812, Jan. 14, 2011, 5 pages.
Statement of Relevance of KR 1020040077349 A.
Abstract of KR1020040077349; Sep. 4, 2004.

* cited by examiner

WIRELESS REMOTE CONTROL

REFERENCE TO RELATED APPLICATIONS

This application is a PCT national-stage application based on PCT/EP2010/004812, filed Aug. 5, 2010, and claims priority to German application 10 2009 036 586.9 filed Aug. 7, 2009, the entire disclosures of which are incorporated by reference.

FIELD OF THE INVENTION

The invention relates to a wireless remote control.

BACKGROUND

Such a remote control is known from WO 2009/015869. This remote control has a position—or movement sensor that switches the energy supply of the remote control on or off. Thus, no extra switch is required that has to be actuated by the user for switching the remote control on or off. If the remote control is moved or brought into a predetermined position in which the, for example, one operating surface faces up, then the remote control is switched on. If the remote control is not moved for a predetermined time or is brought into another predetermined position, for example, with the operating surface facing down, then the remote control is switched off.

A similar remote control is known from KR 1020040077349 A in which a sensor that detects the position of the remote control actuates or deactuates an electronic switching element that connects a battery to a microcontroller.

Remote controls with movement sensor are also known from US2006/750801 B2, U.S. Pat. No. 7,385,548 B2, US2005/0084929 A1 and US2005/0206549 A1.

However, there is the problem in the initially cited remote controls that are actuated or deactuated by a position—or movement sensor that the remote control can be switched on during transport movements or "false" storage, so that the energy supply, i.e., batteries or rechargeable accumulators, are rapidly discharged. A possible solution could consist in removing the batteries or accumulators from the housing of the remote control during long-time storage or transport and not using them until before usage. However, this is not possible in the case of a remote control with a permanently built-in-energy source.

Therefore, the invention has the problem of improving the remote control of the initially cited type in such a manner that a reliable switching off of the energy supply is achieved even during transport or long-time storage.

SUMMARY OF THE INVENTION

Briefly, therefore, the invention is directed to a wireless remote control having a housing, a current supply device arranged in the housing, at least one electronic circuit that is supplied with electrical energy from the power supply device, and with a sensor that generates an output signal as a function of its alignment that directly or indirectly activates or deactivates the at least one electronic circuit. A plug socket is attached to the housing, a first contact of the plug socket is connected to a control input (GP 1) of the power supply device, and an external plug is provided that connects the first contact to a second contact when inserted into the plug socket and thus the current supply device is deactivated independently of the output signal of the sensor.

An advantageous embodiment and further development of the invention can be gathered from the subclaims.

The basic concept of the invention consists in switching off the energy supply independently of the output signal of the sensor by an external plug.

In order to actuate the remote control only the external plug has to be pulled out. In a concrete exemplary embodiment the remote control has a USB connection that is used to program the remote control. A contact of this USB connection, which contact is not otherwise occupied, is connected by the external plug to another contact of the USB connection and particular to its connection to ground, as a result of which the first-cited contact is put on ground potential. The contact is connected to a control input of a microcontroller that is therefore put on ground potential and switches off the power supply. Therefore, only one electrical bridge is present in the external plug.

BRIEF DESCRIPTION OF THE DRAWINGS

The invention is explained in detail in the following using an exemplary embodiment in conjunction with the drawings. In the drawings.

DETAILED DESCRIPTION OF PREFERRED EMBODIMENTS

Figure 1:
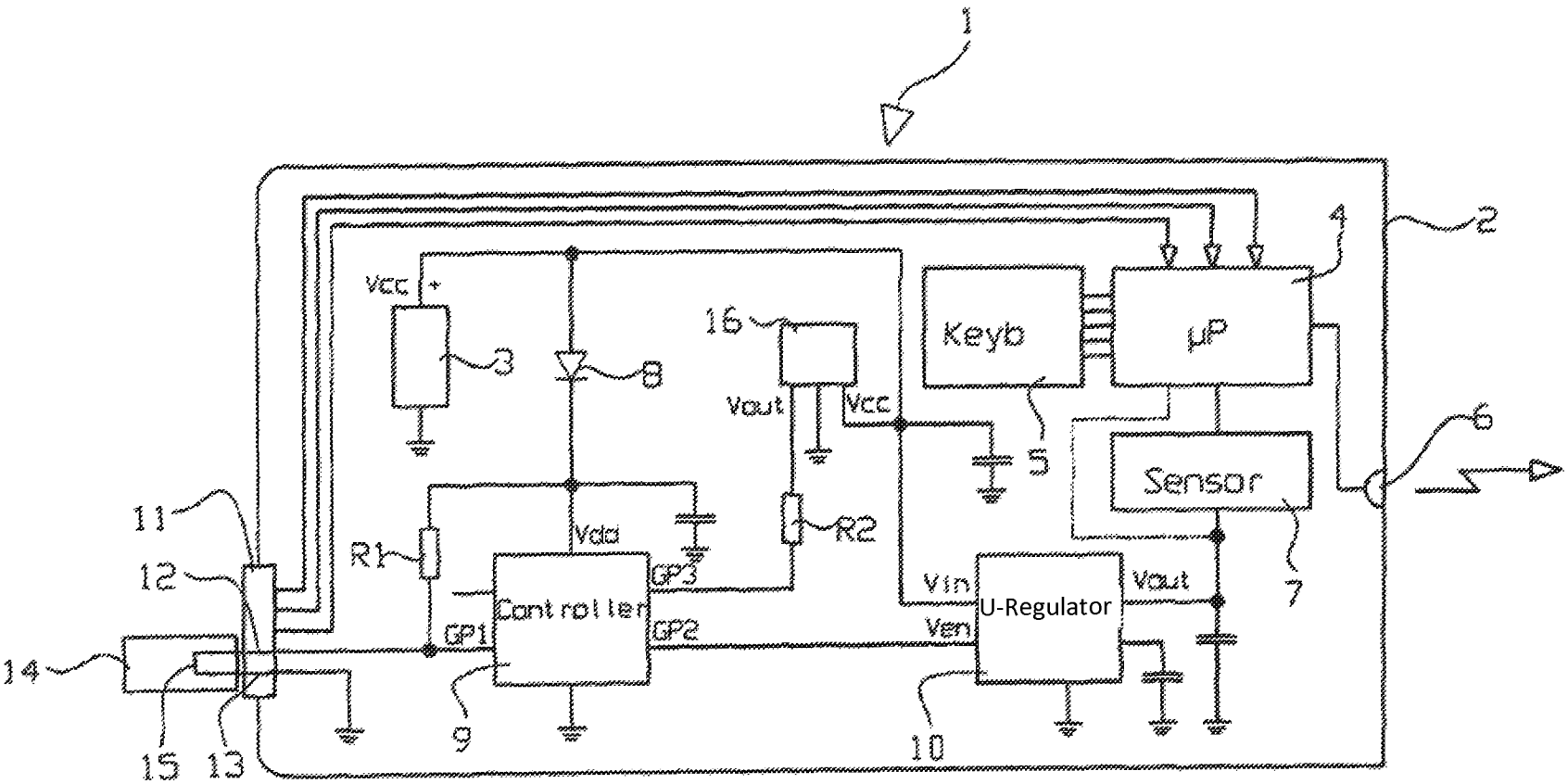
FIG. 1 shows a basic circuit diagram of a remote control in accordance with a first exemplary embodiment of the invention.

FIG. 1 shows a remote control 1 with a housing 2 in which a plurality of electrical and electronic structural elements are arranged as well as a power source 3 that supplies the electrical and electronic structural parts with electrical energy. These parts can be batteries, rechargeable accumulators or other energy stores for electrical energy such as, for example, a capacitor with high capacity, possibly also in combination with a solar cell. The remote control 1 contains, among other things, a microprocessor 4 with which the functions of the remote control are realized. An input apparatus 5 is connected to the microprocessor 4 and can be a key field, a touch-sensitive screen (so-called touch screen) or some other input device with which control commands are inputted into the microprocessor 4. An output of the microprocessor 4 is connected here to a light-emitting diode 6 that transmits infrared signals in most remote controls to a device to be controlled. Of course, even other transmitting units can be used such as, for example, transmitters in the radio frequency range, ultrasonic transmitters or the like.

Furthermore, a sensor 7 is arranged in the housing that is constructed as a position sensor or movement sensor and actuates or deactuates the microprocessor 4 as a function of the detected position or movement. It is also possible to transmit control commands to the microprocessor 4 via the sensor 7 that are defined by certain movement patterns. In this instance the input device 5 can also be omitted.

The power supply of the remote control takes place by the power source 3 in conjunction with one or several electronic structural parts that are designated on the whole as power supply device. The power supply device contains on the whole the power source 3, a controller 9, a voltage regulator 10, optionally a voltage monitoring 6 as well as external wirings of these structural elements.

In the concrete exemplary embodiment a + pole of the current source 3 is connected via a diode 8 to a supply connection of a controller 9. The controller can be, for example, a controller of the type PIC 10F200 of the company Microchip Technology, Inc. 2355 West Chandler Blvd., Chandler, Ariz. 85224-6199, USA. A GP1 connection of the controller 9 is connected via a high-resistive resistor R1 of, for example, 1 M ohms to the diode 8 and therefore puts the supply voltage in normal operation on the connection GP1 of the controller 9. The latter thereupon switches its output GP2 through and therefore puts a "high" signal on an "enable" input Ven of a voltage regulator 10. This voltage regulator can be, for example, a component of the type LP3985 IM5-3.3 of the company National Semi-conductor, 2900 Semiconductor Dr., Santa Clara, Calif., 95052-8090, USA. An input connection Vin of the voltage regulator 10 is connected to the plus pole of the energy supply. If a "high" signal is on the input Ven of the voltage regulator 10, the voltage regulator switches its output Vout to active and emits a regulated output voltage. The Vout voltage of the voltage regulator 10 is connected to the sensor 7 and optionally to a voltage supply input Vin of the microprocessor 4.

Furthermore, an electrical connection 11 accessible from the outside is provided on the housing 1, which is a plug socket of a USB plug connection in the preferred exemplary embodiment. Several contacts of this connection 11 are connected to the microprocessor 4 for programming purposes. A first contact of interest 12 here is connected to the GP1 connection of the controller 4 and a second contact 13 is connected to ground.

An external plug 14 is provided for the secure deactivation of the remote control 1 which plug contains an electrical bridge 15 via which the contacts 12 and 13 are connected to one another during the insertion of the external plug 14 into the connection 11.

As a result, the potential of the connection GP1 of the controller 9 is put on ground potential and the output GP2 of the controller 9 switches to low level. The voltage regulator is switched off by the low signal on its enable input Ven and there is no voltage on the output Vout of the voltage regulator 10. Thus, the sensor 7 and the microprocessor 4 are separated from any voltage supply. Only a minimal current can still flow via the diode 8 and the resistor R1 that amounts to a maximum of 10 μA in the customarily used accumulators, so that a completely charged accumulator with ca. 350 mAh can be stored ca. 3 years. In order to activate the remote control the external plug 14 is taken out. Therefore, high potential is again on the connection GP1 of the controller 9 and the remote control is actuated so that the sensor 7 is responsible for the switching on and off of the remote control.

In order to prevent a total discharge of the power source 3 even in activated remote control, yet another voltage detector 16 is provided whose supply connection Vcc is connected to the plus pole of the power source 3 and whose output Vout is connected via a resistor R2 to a connection GP of the controller 9. The voltage detector can be, for example, a component of the type MPC112T-315E/LB of the above-cited company Mikrochip Technologie Inc. The voltage detector 16 monitors the level of the input voltage Vcc. If this voltage is above a predetermined value, it puts a high signal at its output via its resistor R2 on the connection GP3 of the controller 9, that acts here as a second enable input of the controller 9 and ensures that a high signal is on the output GP2 if a high signal is present on the input GP3 and at the same time also on the input GP1. If the supply voltage drops below the value given by the voltage detector 16, then its output Vout switches to low signal and thus deactivates the controller 9 and the latter deactivates the voltage regulator 10.

Figure 2:
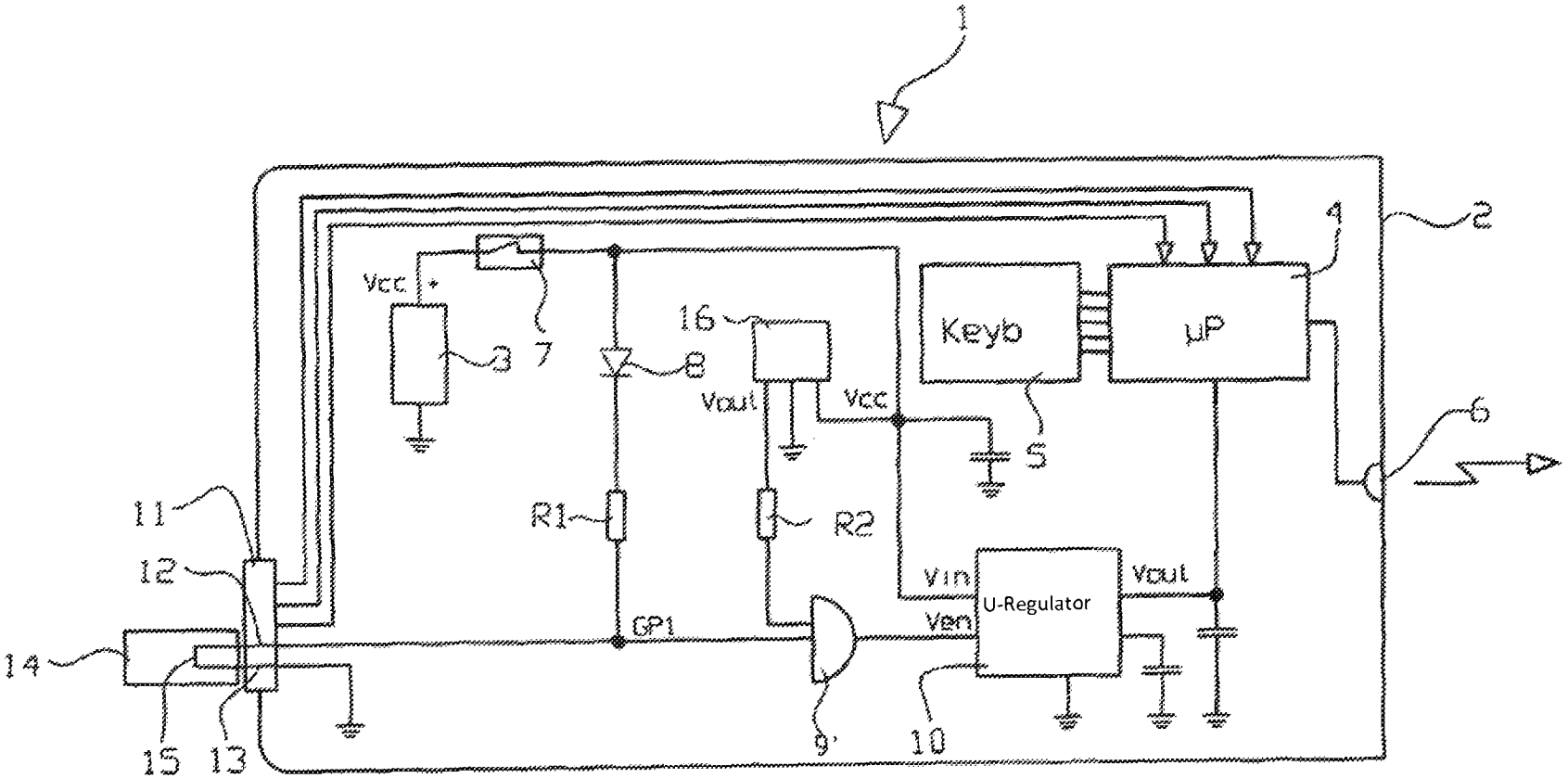
FIG. 2 shows a basic circuit diagram of a remote control in accordance with a second exemplary embodiment of the invention.

FIG. 2 shows a second exemplary embodiment of the invention that differs from the one in FIG. 1 substantially by the sensor 7 and the controller 9. The sensor 7 here is a position sensor with a switch that opens or closes as a function of the position of the sensor. It can be, for example, a switch activated by gravity or a mercury switch. This switch is then advantageously connected directly to the plus pole of the current source 3. Furthermore, the controller 9 of the example of FIG. 1 is omitted. The contact 12 is then connected via the resistor R1 and the diode 8 as well as the sensor 7 to the plus pole Ven of the voltage regulator 10. This last-cited connection can be direct. For the case that a voltage monitoring 16 is also provided, instead of the controller 9 of FIG. 1 an AND gate 9' is provided whose output is connected to the input Ven of the voltage regulator 10 and whose inputs are connected to the contact 12 and output of the voltage monitoring.

Even if the switch present in the sensor 7 is closed, the energy supply delivered from the voltage regulator 10 is deactivated until a high level is present on both inputs of the AND gate 9'. If the external plug 14 is inserted, then at least one input connection of the AND gate 9' conducts a low level, wherewith the voltage supply is securely switched off.

In sum, therefore, the invention creates a very simple and secure possibility for switching off or deactivating a remote control, even if its activation and deactivation is otherwise carried out by a movement sensor or position sensor.

The invention claimed is:

1. A wireless remote control comprising:

a housing, a power supply device arranged in the housing, at least one electronic circuit that is supplied with electrical energy from the power supply device, a sensor that generates an output signal as a function of its alignment or movement that directly or indirectly activates or deactivates the at least one electronic circuit, a plug socket attached to the housing, a first contact of the plug socket connected to a control input of the power supply device, an external plug having a casing and an electrical bridge connected with the first contact of the plug socket and connected with a second contact of the plug socket, wherein the electrical bridge connects the control input of the power supply device via the first contact to the second contact of the plug socket when the external plug is inserted into the plug socket; wherein inserting the external plug into the plug socket deactivates the at least one electronic circuit independently from the output signal of the sensor; and wherein the external plug and the plug socket are of the USB type.

2. The wireless remote control according to claim 1 wherein the first contact is connected to the control input of the power supply device and the second contact is a ground contact.

* * * * *